US005230312A

United States Patent [19]

Baika et al.

[11] Patent Number: 5,230,312

[45] Date of Patent: Jul. 27, 1993

[54] TWO-STROKE ENGINE

[75] Inventors: Toyokazu Baika, Susono; Norihiko Nakamura, Mishima; Tadashi Fukuyama; Takeshi Sato, both of Susono; Koichi Nakae, Susono, all of Japan

[73] Assignee: Toyota Jidosha Kabushiki Kaisha, Aichi, Japan

[21] Appl. No.: 962,719

[22] Filed: Oct. 19, 1992

[30] Foreign Application Priority Data

Nov. 8, 1991 [JP] Japan ..... 3-292740

[51] Int. Cl.[5] ..... F02B 25/20; F02B 23/04; F02B 19/08

[52] U.S. Cl. ..... 123/257; 123/65 VD

[58] Field of Search ..... 123/65 VD, 257, 302, 123/432

[56] References Cited

U.S. PATENT DOCUMENTS

| | | | |
|---|---|---|---|
| Re. 32,802 | 12/1988 | Kline | 123/65 VD |
| 3,125,077 | 3/1964 | Monnot et al. | 123/257 |
| 4,162,662 | 7/1979 | Melchior | 123/65 VD |
| 4,418,655 | 12/1983 | Henning | 123/41.82 R |
| 4,840,147 | 6/1989 | Tanahashi et al. | 123/65 VD |
| 4,945,867 | 8/1990 | Tanahashi et al. | 123/65 VD |
| 5,070,834 | 12/1991 | Ueno et al. | 123/275 |
| 5,125,380 | 6/1992 | Nakae et al. | 123/257 |

FOREIGN PATENT DOCUMENTS

| | | |
|---|---|---|
| 1-277619 | 11/1989 | Japan . |
| 674713 | 6/1952 | United Kingdom . |

*Primary Examiner*—Tony M. Argenbright
*Attorney, Agent, or Firm*—Oliff & Berridge

[57] ABSTRACT

A two-stroke engine comprising three exhaust valves and two intake valves. These exhaust valves and these intake valves are arranged on the peripheral portion of the inner wall of the cylinder head, and one additional intake valve is arranged on the central portion of the inner wall of the cylinder head. The valve openings of the three intake valves, which are located on the exhaust valves side, are masked by the masking walls. The central portion of the combustion chamber is scavenged by the fresh air fed from the additional intake valve, and the peripheral portion of the combustion chamber is scavenged by the fresh air fed from the remaining two intake valves.

22 Claims, 18 Drawing Sheets

TWO-STROKE ENGINE

BACKGROUND OF THE INVENTION

1. Field of the Invention

The present invention relates to a two-stroke engine.

2. Description of the Related Art

In a known two-stroke engine, a pair of exhaust valves are arranged on the peripheral portion of the inner wall of the cylinder head, and a pair of intake valves are arranged on the peripheral portion of the inner wall of the cylinder head at a position opposite to the pair of exhaust valves. The valve opening of each intake valve, which is located on the exhaust valve side, is masked by the masking wall to prevent fresh air from flowing out from the valve opening of each intake valve, which is located on the exhaust valve side. The fresh air flowing out from the unmasked valve opening of each intake valve, which is located on the opposite side of the exhaust valve, is caused to flow downward along the inner wall of the cylinder bore beneath the intake valve. Then, the fresh air flows along the top face of the piston and then flows upward along the inner wall of the cylinder bore beneath the exhaust valve (see Japanese Unexamined Patent Publication No. 1-277619). This two-stroke engine is designed so as to scavenge burned gas as efficiently as possible by causing the fresh air flowing out from the intake valves to flow along the periphery of the combustion chamber in the form of a loop.

However, if the fresh air is caused to flow along the periphery of the combustion chamber in a loop-like manner, the unburned gas existing in the periphery of the combustion chamber can be sufficiently scavenged by the fresh air, but the unburned gas existing at the central portion of the combustion chamber is not scavenged by the fresh air and thus stays in the combustion chamber. As a result, a problem arises in that it is impossible to sufficiently scavenge all of the unburned gas in the combustion chamber.

SUMMARY OF THE INVENTION

An object of the present invention is to provide a two-stroke engine capable of sufficiently scavenging all of the unburned gas in the combustion chamber.

According to the present invention, there is provided a two-stroke engine having a piston, a cylinder head and a combustion chamber formed between the piston and the cylinder head, the engine comprising: at least one exhaust valve arranged on a peripheral portion of an inner wall of the cylinder head; at least one intake valve arranged on a peripheral portion of the inner wall of the cylinder head at a position opposite to the exhaust valve; preventing means for preventing an inflow of fresh air into the combustion chamber from a valve opening of the intake valve, which is located on the exhaust valve side, and causing the fresh air to flow into the combustion chamber from a valve opening of the intake valve, which is located opposite to the exhaust valve, to cause the fresh air to flow along a periphery of the combustion chamber; and an additional valve arranged at a central portion of the inner wall of the cylinder head to feed fresh air toward a central portion of the combustion chamber.

The present invention may be more fully understood from the description of preferred embodiments of the invention set forth below, together with the accompanying drawings.

DESCRIPTION OF PREFERRED EMBODIMENTS

Figure 1:
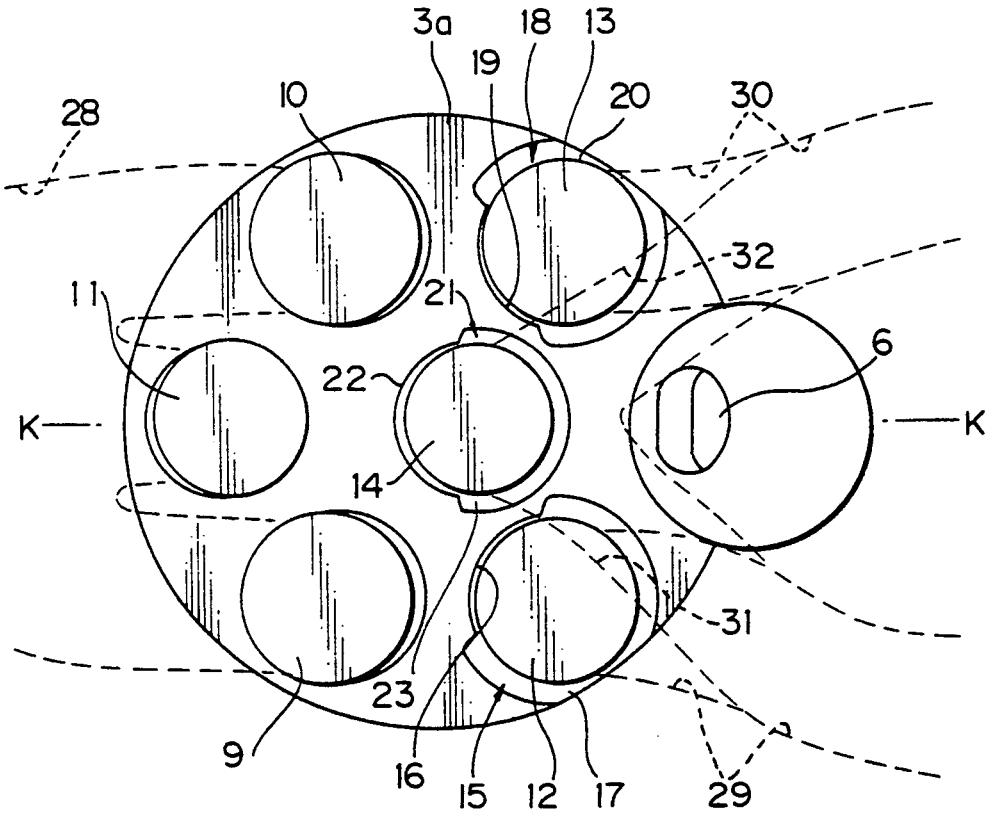
FIG. 1 is a view illustrating the inner wall of the cylinder head.

FIGS. 1 through 4 illustrate the case where the present invention is applied to a two-stroke diesel engine. However, the present invention may be applied to a two-stroke spark-ignition engine.

Referring to FIGS. 1 through 4, reference numeral 1 designates a cylinder block, 2 a piston reciprocally movable in the cylinder block 1, 3 a cylinder head fixed to the cylinder block 1, and 4 a main chamber formed between the top face of the piston 2 and the inner wall 3*a* of the cylinder head 3; 5 designates an auxiliary chamber formed in the cylinder head 3 above the peripheral portion of the inner wall 3*a* of the cylinder head 3, 6 an opening of the auxiliary chamber 5, which is open to the main chamber 4, 7 a fuel injection for injecting fuel into the auxiliary chamber 5, and 8 a glow plug arranged in the auxiliary chamber 5.

Figure 2:
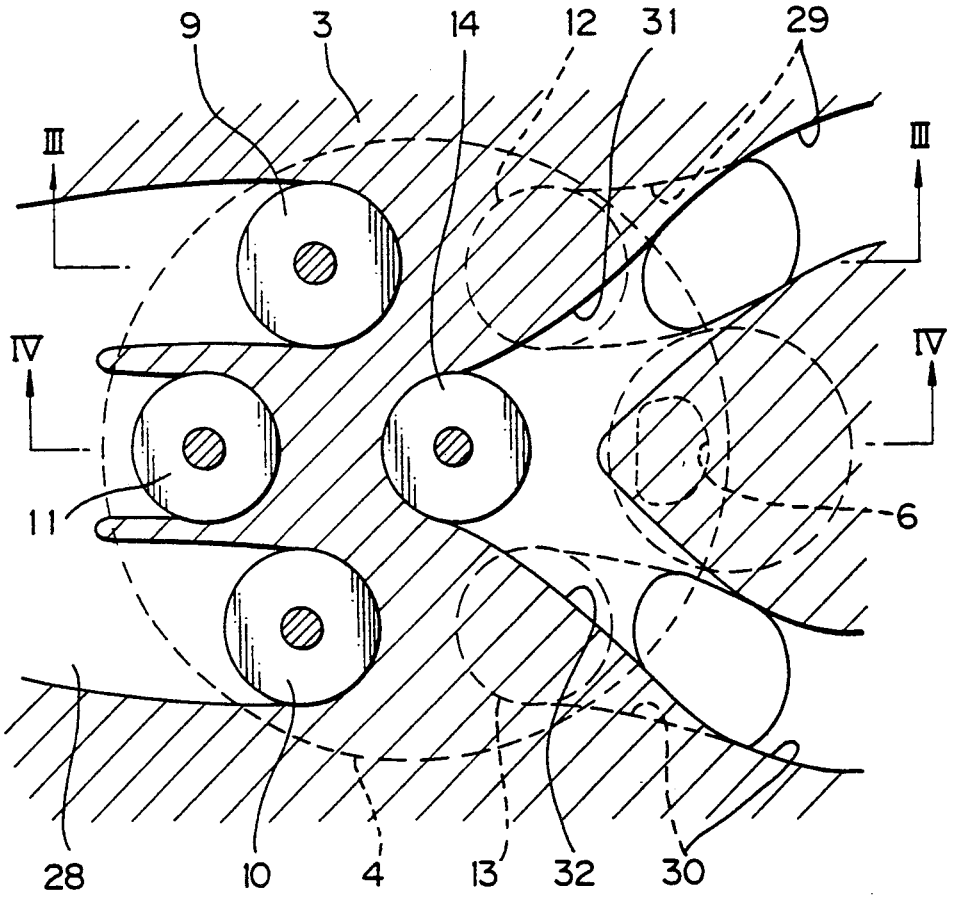
FIG. 2 is a cross-sectional plan view of the cylinder head.

In the embodiment illustrated in FIGS. 1 through 4, as illustrated in FIGS. 1 and 2, three exhaust valves 9, 10, 11 are arranged on the peripheral portion of the inner wall 3*a* of the cylinder head 3, and a pair of intake valves 12, 13 are arranged on the peripheral portion of the inner wall 3*a* of the cylinder head 3 at a position opposite to the exhaust valves 9, 10, 11. In addition, a third intake valve, i.e., an additional intake valve 14 is arranged at the central portion of the inner wall 3a of the cylinder head 3. As illustrated in FIG. 1, the exhaust valves 9, 10 are symmetrically arranged with respect to a symmetrical plane K—K including the axis of the cylinder, and the intake valves 12, 13 are also symmetrically arranged with respect to the symmetrical plane K—K. In addition, the opening 6 of the auxiliary chamber 5 is arranged on the peripheral portion of the inner wall 3a of the cylinder head 3, which portion is surrounded by the three intake valves 12, 13, 14, and furthermore, the exhaust valve 11, the intake valve 14 and the opening 6 are arranged on the symmetrical plane K—K. Accordingly, in the embodiment illustrated in FIGS. 1 through 4, the arrangement is such that the three exhaust valves 9, 10, 11, a pair of the intake valves 12, 13 and the opening 6 are approximately equiangularly arranged on the peripheral portion of the inner wall 3a of the cylinder head 3, and the additional intake valve 14 is arranged at the central portion of the inner wall 3a of the cylinder head 3.

Figure 3:
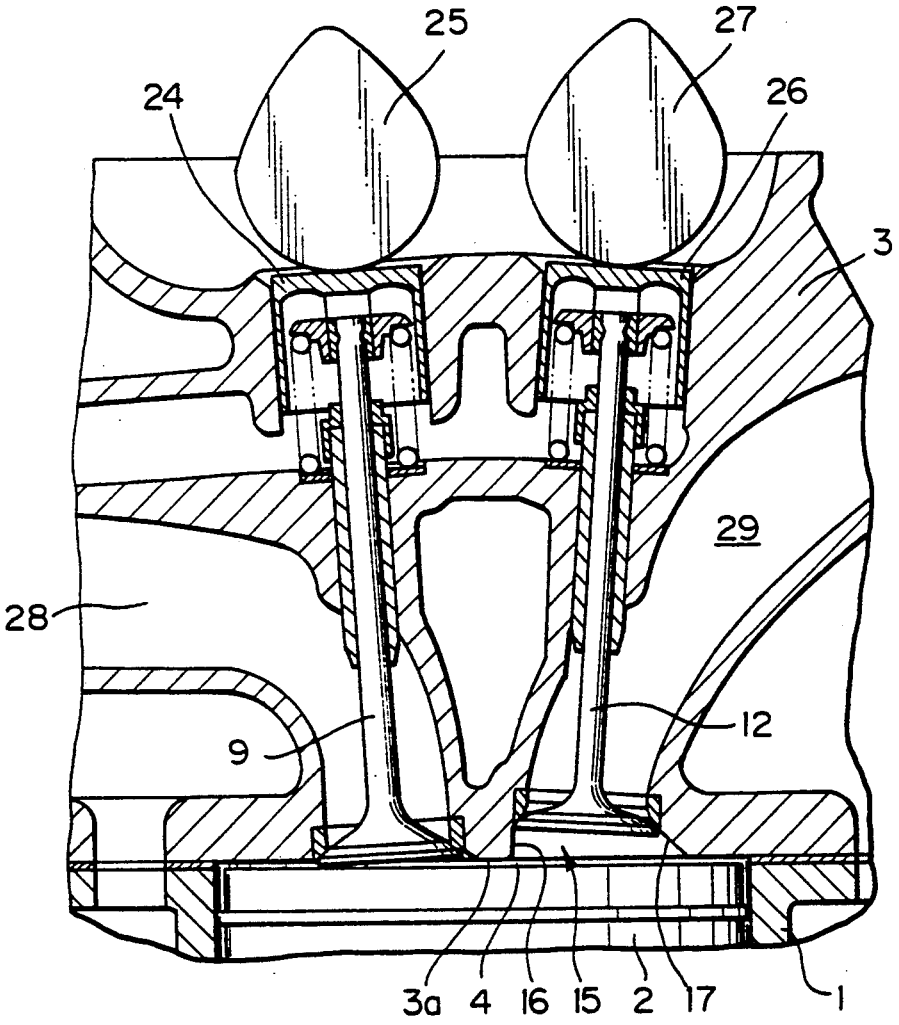
FIG. 3 is a cross-sectional side view of an engine, taken along the line III—III in FIG. 2.

As illustrated in FIGS. 1 and 3, a recessed portion 15 is formed on the inner wall 3a of the cylinder head 3, and the intake valve 12 are arranged in the deep interior of the recessed portion 15. The inner circumferential wall portion 16 of the recessed portion 15, which is located on the exhaust valves side, has a cylindrical shape extending along the outer periphery of the intake valve 12, and the remaining inner circumferential wall portion 17 of the recessed portion 15 other than the cylindrical inner circumferential wall portion 16 has a conical shape diverging toward the main chamber 4. Accordingly, the valve opening of the intake valve 12, which faces the cylindrical inner circumferential wall portion 16, is masked by this wall portion 16, and thus this cylindrical inner circumferential wall portion 16 forms a masking wall for masking the valve opening of the intake valve 12, which is located on the exhaust valves side. In the embodiment illustrated in FIGS. 1 through 4, the masking wall 16 extends toward the main chamber 4 to a position lower than the intake valve 12 when the intake valve 12 is in the maximum lift position, and thus the valve opening of the intake valve 12, which is located on the exhaust valves side, is masked by the masking wall 16 for the entire time for which the intake valve 12 is open. However, the height of the masking wall 16 may be slightly lowered to mask the valve opening of the intake valve 12 only when the amount of the valve lift of the intake valve 12 is small.

In addition, as illustrated in FIG. 1, a recessed portion 18 having a shape which is symmetrical with the recessed portion 15 with respect to the symmetrical plane K—K is formed on the inner wall 3a of the cylinder head 3, and the intake valve 13 are arranged in the deep interior of the recessed portion 18. The inner circumferential wall portion 19 of the recessed portion 18, which is located on the exhaust valves side, has a cylindrical shape extending along the outer periphery of the intake valve 13, and the remaining inner circumferential wall portion 20 of the recessed portion 18 other than the cylindrical inner circumferential wall portion 19 has a conical shape diverging toward the main chamber 4. Accordingly, the valve opening of the intake valve 13, which faces the cylindrical inner circumferential wall portion 19, is masked by this wall portion 19, and thus this cylindrical inner circumferential wall portion 19 forms a masking wall for masking the valve opening of the intake valve 13, which is located on the exhaust valves side. In the embodiment illustrated in FIGS. 1 through 4, similarly to the masking wall 16, the masking wall 19 extends toward the main chamber 4 to a position lower than the intake valve 13 when the intake valve 13 is in the maximum lift position, and thus the valve opening of the intake valve 13, which is located on the exhaust valves side, is masked by the masking wall 19 for the entire time for which the intake valve 13 is open. However, the height of the masking wall 19 also may be slightly lowered to mask the valve opening of the intake valve 13 only when the amount of the valve lift of the intake valve 13 is small.

Figure 4:
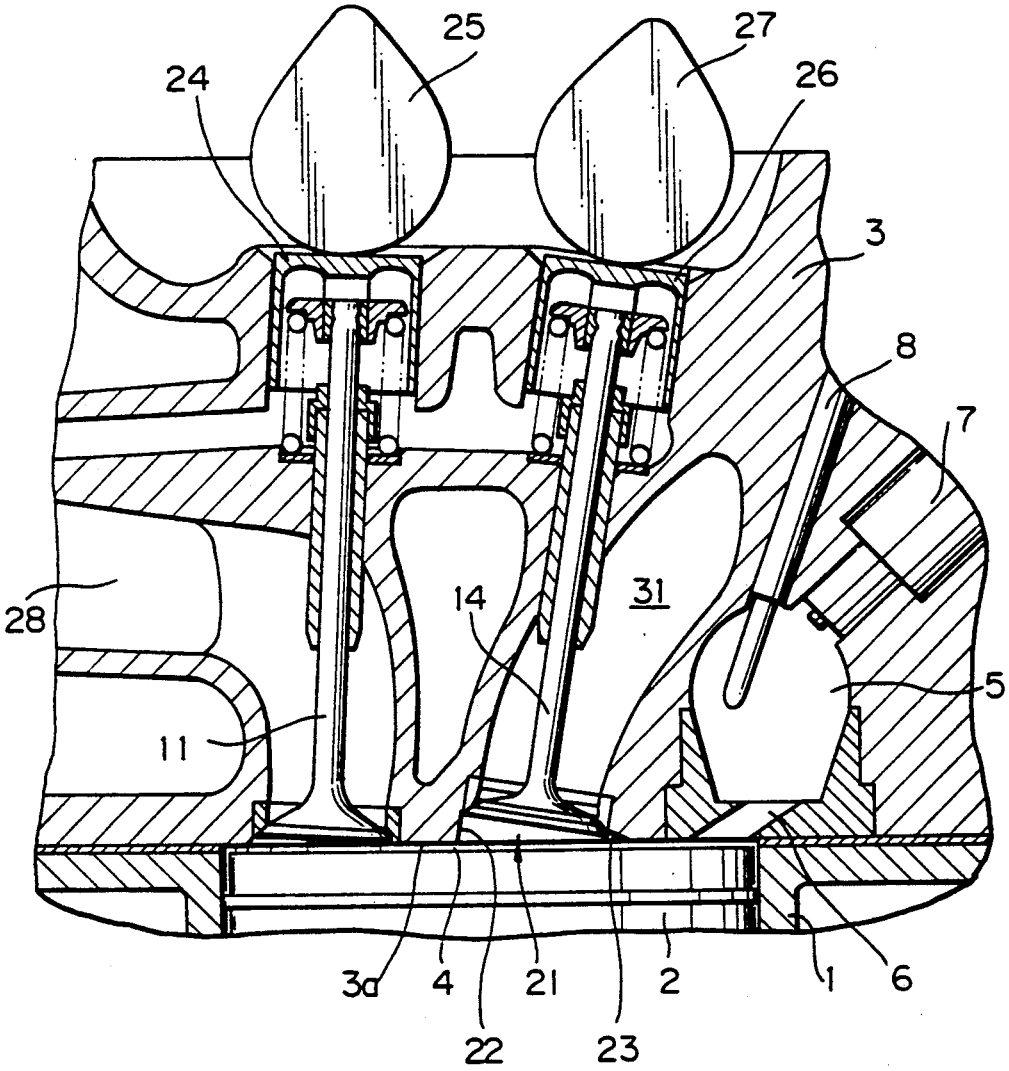
FIG. 4 is a cross-sectional side view of the engine, taken along the line IV—IV in FIG. 2.

Furthermore, as illustrated in FIGS. 1 and 4, a recessed portion 21 is formed on the inner wall 3a of the cylinder head 3, and the intake valve 14 are arranged in the deep interior of the recessed portion 21. The inner circumferential wall portion 22 of the recessed portion 21, which is located on the exhaust valves side, has a cylindrical shape extending along the outer periphery of the intake valve 14, and the remaining inner circumferential wall portion 23 of the recessed portion 21 other than the cylindrical inner circumferential wall portion 22 has a conical shape diverging toward the main chamber 4. Accordingly, the valve opening of the intake valve 14, which faces the cylindrical inner circumferential wall portion 22, is masked by this wall portion 22, and thus this cylindrical inner circumferential wall portion 22 forms a masking wall for masking the valve opening of the intake valve 14, which is located on the exhaust valves side. In the embodiment illustrated in FIGS. 1 through 4, similarly to the masking walls 16, 19, the masking wall 22 extends toward the main chamber 4 to a position lower than the intake valve 14 when the intake valve 14 is in the maximum lift position, and thus the valve opening of the intake valve 14, which is located on the exhaust valves side, is masked by the masking wall 22 for the entire time for which the intake valve 14 is open. However, the height of the masking wall 14 also may be slightly lowered to mask the valve opening of the intake valve 14 only when the amount of the valve lift of the intake valve 14 is small.

With respect to the exhaust valves 9, 10, 11, no masking wall is provided, and thus, when the exhaust valves 9, 10, 11 open, the valve openings of the exhaust valves 9, 10, 11 open as a whole to the interior of the main chamber 4.

In the embodiment illustrated in FIGS. 1 through 4, all the exhaust valves 9, 10, 11 are driven by a common cam shaft 25 via corresponding valve lifters 24 which are slidably inserted into the cylinder head 3, and all the intake valves 12, 13, 14 are driven by a common cam shaft 27 via corresponding valve lifters 26 which are slidably inserted into the cylinder head 3. Namely, all the exhaust valves 9, 10, 11 are directly driven by the common cam shaft 25, positioned on the axes of the exhaust valves 9, 10, 11, without routing a rocker arm, and all the intake valves 12, 13, 14 are also directly driven by the common cam shaft 27, positioned on the axes of the intake valves 12, 13, 14, without routing a rocker arm.

An exhaust port 28 common to all the exhaust valves 9, 10, 11 and extending to the exhaust valves 9, 10, 11 is formed in the cylinder head 3, and a pair of intake ports 29, 30 extending to the intake valves 12, 13 on each side of the auxiliary chamber 5 are formed in the cylinder head 3. In addition, a pair of branch intake passages 31, 32 branched off from the corresponding intake ports 29, 30 are formed in the cylinder head 3. These branch intake passages 29, 30 extend to the intake valve 14 and are merged with each other in the vicinity of the intake valve 14. Accordingly, the fresh air is fed from the intake valves 12, 13 via the corresponding intake ports 29, 30, and the fresh air distributed from the intake ports 29, 30 into the branch intake passages 31, 32 is fed from the intake valve 14.

Figure 5:
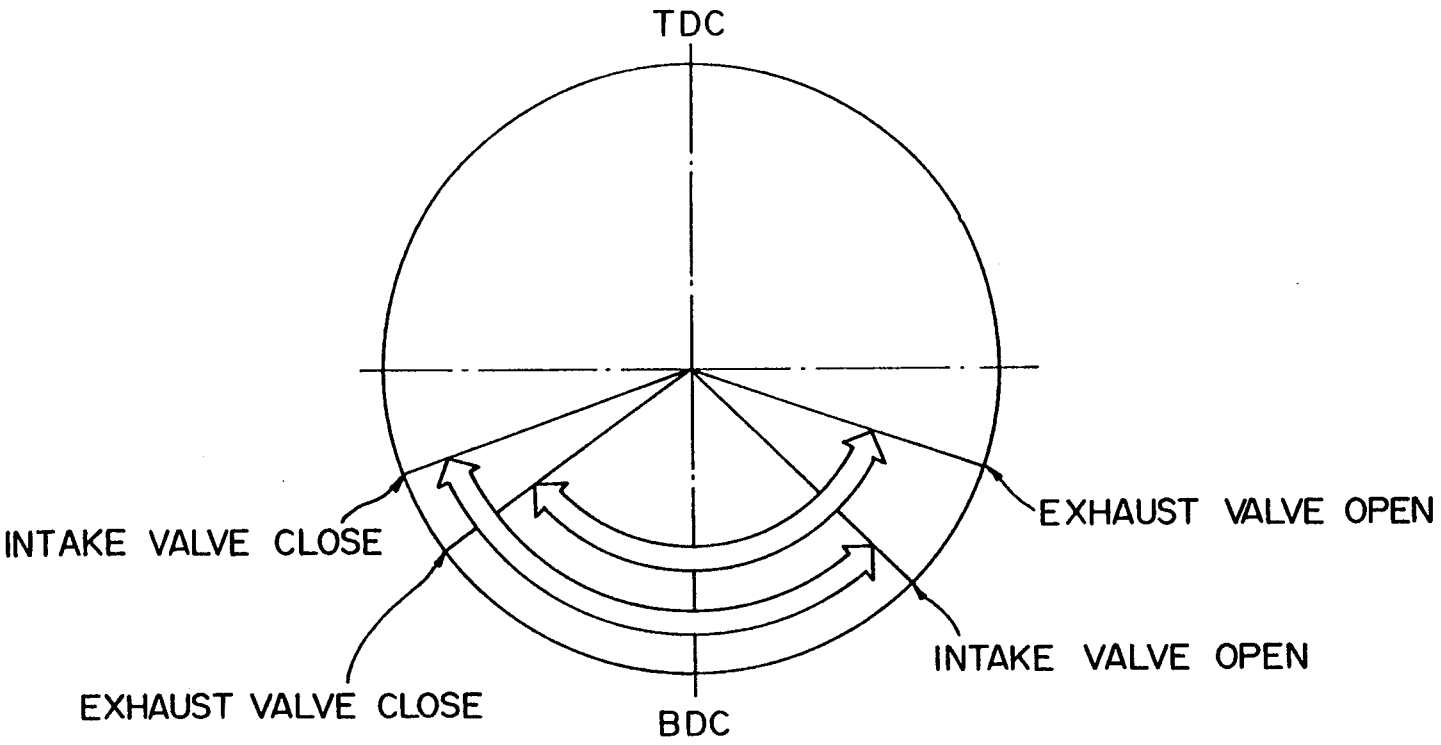
FIG. 5 is a diagram illustrating the opening times of the exhaust valves and the intake valves.

FIG. 5 illustrates the opening times of the exhaust valves 9, 10, 11 and the intake valves 12, 13, 14. As illustrated in FIG. 5, the exhaust valves 9, 10, 11 open earlier than the intake valves 12, 13, 14, and the exhaust valves 9, 10, 11 are closed earlier than the intake valves 12, 13, 14.

Figure 6:
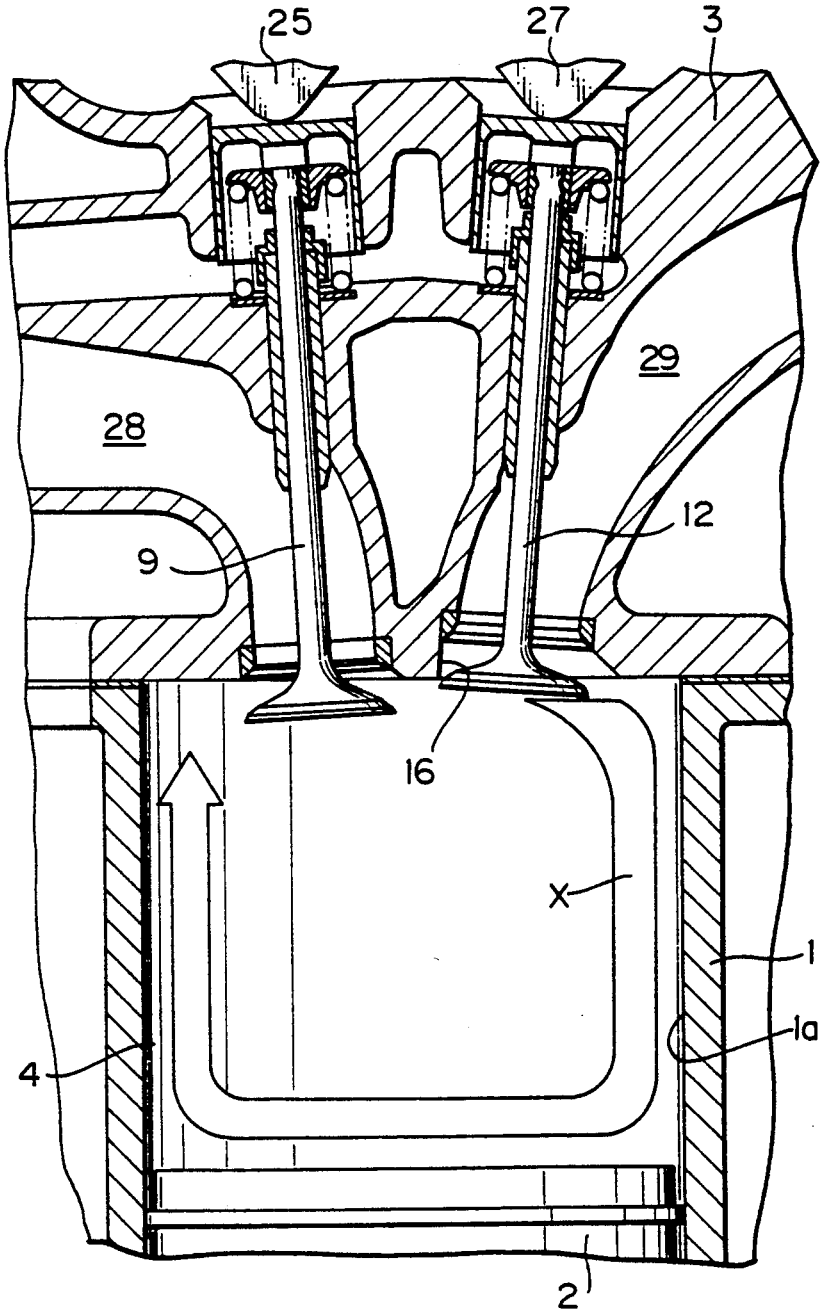
FIG. 6 is a cross-sectional side view of the engine, taken along the same line as in FIG. 3.

Next, the operation of the two-stroke diesel engine illustrated in FIGS. 1 through 4 will be described with reference to FIGS. 6 through 8.

As mentioned above, the exhaust valves 9, 10, 11 open earlier than the intake valves 12, 13, 14. When the exhaust valves 9, 10, 11 open, the unburned gas in the main chamber 4 is abruptly discharged into the exhaust port 28. Namely, the blow down occurs. As a result, the pressure in the main chamber 4 abruptly drops. If the pressure in the main chamber 4 drops, the unburned gas in the auxiliary chamber 5 flows out into the main chamber 4 via the opening 6.

When the intake valves 12, 13, 14 open, the fresh air fed into the intake ports 29, 30 from the mechanically driven supercharger (not shown) driven by the engine is fed into the main chamber 4 via the intake valves 12, 13, 14. At this time, since the valve openings of the intake valves 12, 13, 14, which are located on the exhaust valves side, are masked by the corresponding masking walls 16, 19, 22 as mentioned above, the fresh air flows into the main chamber 4 via the valve openings of the intake valves 12, 13, 14, which are located on the opposite side of the exhaust valves 9, 10, 11. In this case, since the two intake valves 12, 13 are arranged on the peripheral portion of the inner wall 3*a* of the cylinder head 3, the fresh air fed from the intake valves 12, 13 flows downward along the inner wall 1*a* of the cylinder bore beneath the intake valves 12, 13, as illustrated by the arrows X in FIGS. 6 and 8. Then, the fresh air flows along the top face of the piston 2 and then flows upward along the inner wall 1*a* of the cylinder bore beneath the exhaust valves 9, 10. Namely, the fresh air fed from the intake valves 12, 13 flows along the periphery of the main chamber 4 in the form of a loop, and the unburned gas in the main chamber 4 is discharged from the exhaust valves 9, 10, 11 by the fresh air X flowing in the form of a loop. Accordingly, the periphery of the main chamber 4 is scavenged by the fresh air X fed from the intake valves 12, 13.

Figure 7:
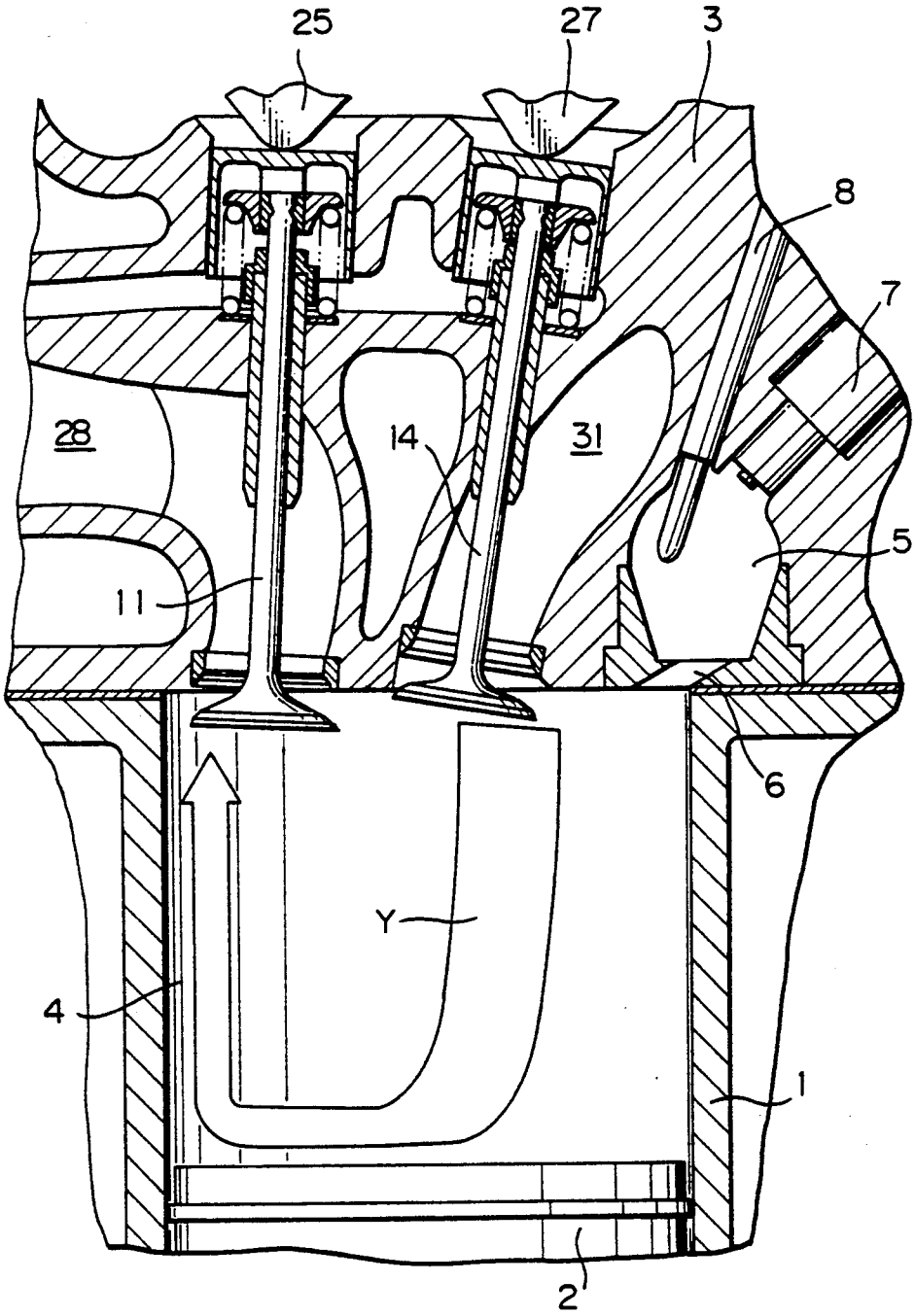
FIG. 7 is a cross-sectional side view of the engine, taken along the same line as in FIG. 4.
Figure 8:
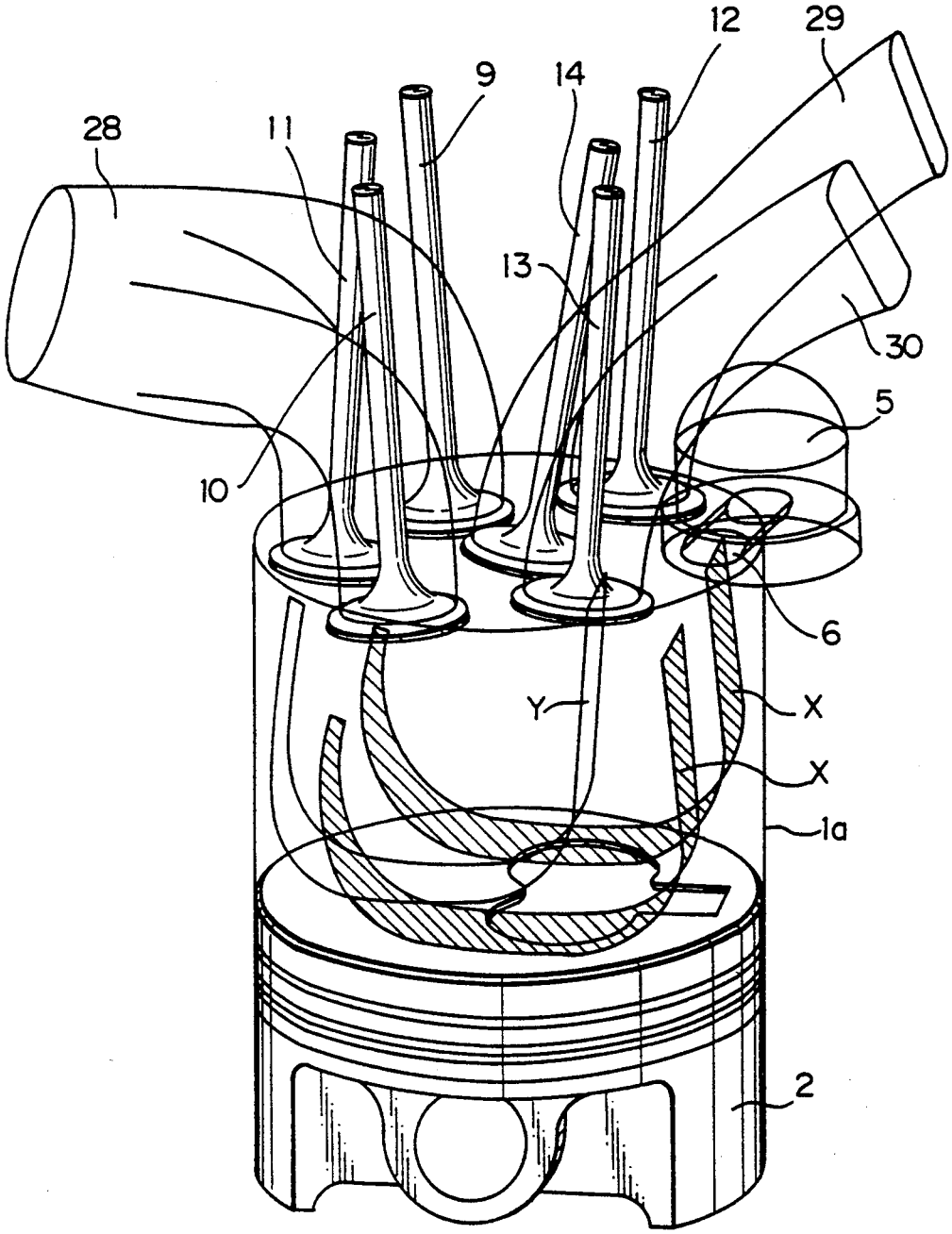
FIG. 8 is a schematically illustrated perspective view of the engine.
Figure 9:
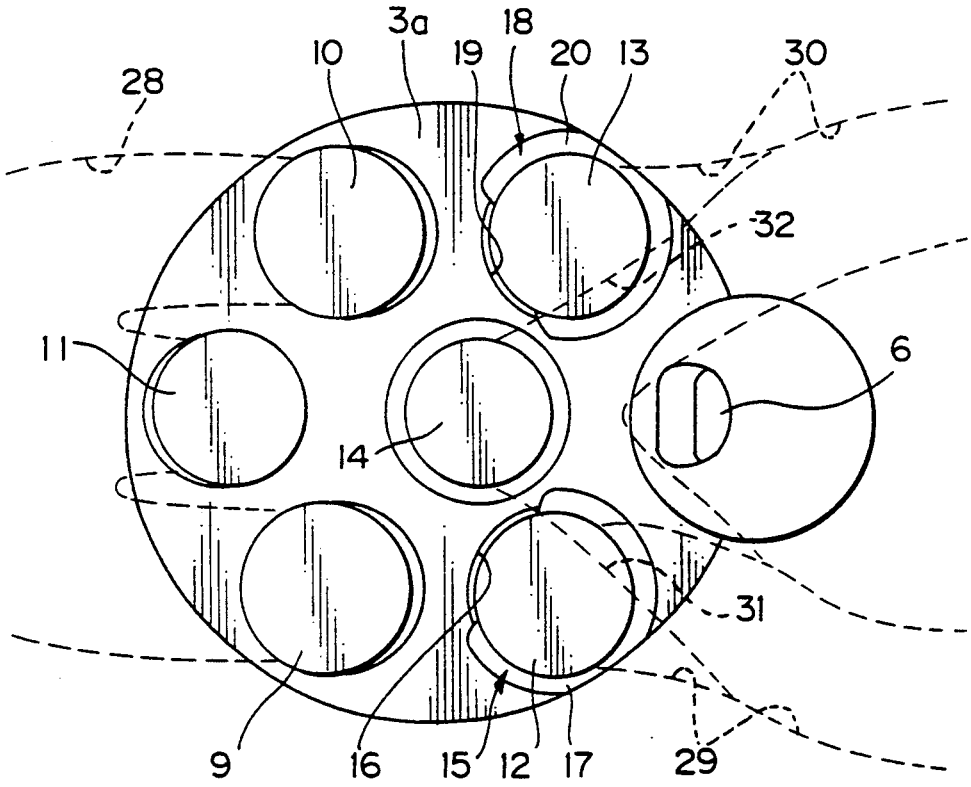
FIG. 9 is a view illustrating the inner wall of the cylinder head of another embodiment.

Conversely, since the intake valve 14 is arranged at the central portion of the inner wall 3*a* of the cylinder head 3, the fresh air fed from the intake valve 14 flows downward in the central portion of the main chamber 4, as illustrated by the arrow Y in FIGS. 7 and 8. Then, the fresh air changes its flow direction on the top face of the piston 2 and then flows upward along the inner wall 1*a* of the cylinder bore beneath the exhaust valves 9, 10, 11. The burned gas existing in the central portion of the main chamber 4 is discharged into the exhaust port 28 by this fresh air Y, and thus the central portion of the main chamber 4 is scavenged by the fresh air Y fed from the intake valve 14. As mentioned above, since the peripheral portion of the main chamber 4 is scavenged by the fresh air fed from the intake valves 12, 13, and the central portion of the main chamber 4 is scavenged by the fresh air fed from the intake valve 14, the entire interior of the main chamber 4 is scavenged by the fresh air fed from the intake valves 12, 13, 14.

When the exhaust valves 9, 10, 11 are closed, and the intake valves 12, 13, 14 are closed, the gas in the main chamber 4 is forced into the auxiliary chamber 5 via the opening 6 due to the upward movement of the piston 2. As mentioned above, since the entire interior of the main chamber 4 is sufficiently scavenged, the gas containing a large amount of fresh air therein is forced into the auxiliary chamber 5, and thus fuel injected into the auxiliary chamber 5 by the fuel injector 7 is properly burned.

If the pressure in the main chamber 4 is high when the intake valves 12, 13, 14 open, the burned gas in the main chamber 4 flows back into the intake ports 29, 30. However, if such a flow back of the burned gas occurs, the mechanically driven supercharger must do an excessive amount of work for returning the burned gas, which has flown back, to the main chamber 4 and then discharging this burned gas into the exhaust port 28, and as a result, the loss of the output power of the engine is increased by an amount corresponding to the excessive work of the supercharger. To prevent the burned gas from flowing back into the intake ports 29, 30, the pressure produced in the main chamber 4 when the intake valves 12, 13, 14 open must be lowered. To this end, it is necessary to discharge the burned gas into the exhaust port 28 as quickly as possible when the exhaust valves 9, 10, 11 open.

However, a time interval between the opening operation of the exhaust valves 9, 10, 11 and the opening operation of the intake valves 12, 13, 14 is extremely short, and, in order to quickly discharge the unburned gas during such a short time interval, it is necessary to open the exhaust valves 9, 10, 11 at a high speed. In this case, if the exhaust valves 9, 10, 11 are driven via rocker arms, the opening speeds of the exhaust valves 9, 10, 11 become low because of the elastic deformation, etc., of the rocker arms. Accordingly, in the embodiment according to the present invention, to increase the opening speeds of the exhaust valves 9, 10, 11, the exhaust valves 9, 10, 11 are directly driven by the cam shaft 27 without routing a rocker arm.

In addition, since the temperature of the auxiliary chamber 5 becomes considerably high, the temperature of the inner wall 3*a* of the cylinder head 3 around the opening 6 becomes considerably high, as compared to the other portion of the inner wall 3*a*, and thus a crack is easily produced in the inner wall 3*a* of the cylinder head 3 around the opening 6. However, in the embodiment according to the present invention, as illustrated in FIG. 1, since the opening 6 is arranged so as to be surrounded by the three intake valves 12, 13, 14, the inner wall 3*a* of the cylinder head 3 is cooled by the fresh air fed from the intake valves 12, 13, 14, and thus it is possible to prevent a crack from being produced in the inner wall 3*a* of the cylinder head 3 around the opening 6.

FIGS. 9 through 13 illustrate another embodiment. In this embodiment, the exhaust valves 9, 10, 11 and the exhaust port 28 have a construction which is the same as that in the embodiment illustrated in FIGS. 1 through 4, and the intake valves 12, 13, 14, the intake ports 29, 30 and the masking walls 16, 19 have a construction which is the same as that in the embodiment illustrated in FIGS. 1 through 4. In addition, the auxiliary chamber 5 and the opening 6 also have a construction which is the same as that in the embodiment illustrated in FIGS. 1 through 4. Namely, the intake valves 12 and 13 are arranged in the recessed portions 15 and 18 formed on the inner wall 3*a* of the cylinder head 3, respectively, and the valve openings of the intake valves 12, 13, which are located on the exhaust valves side, are masked by the corresponding masking walls 16, 19.

Figure 10:
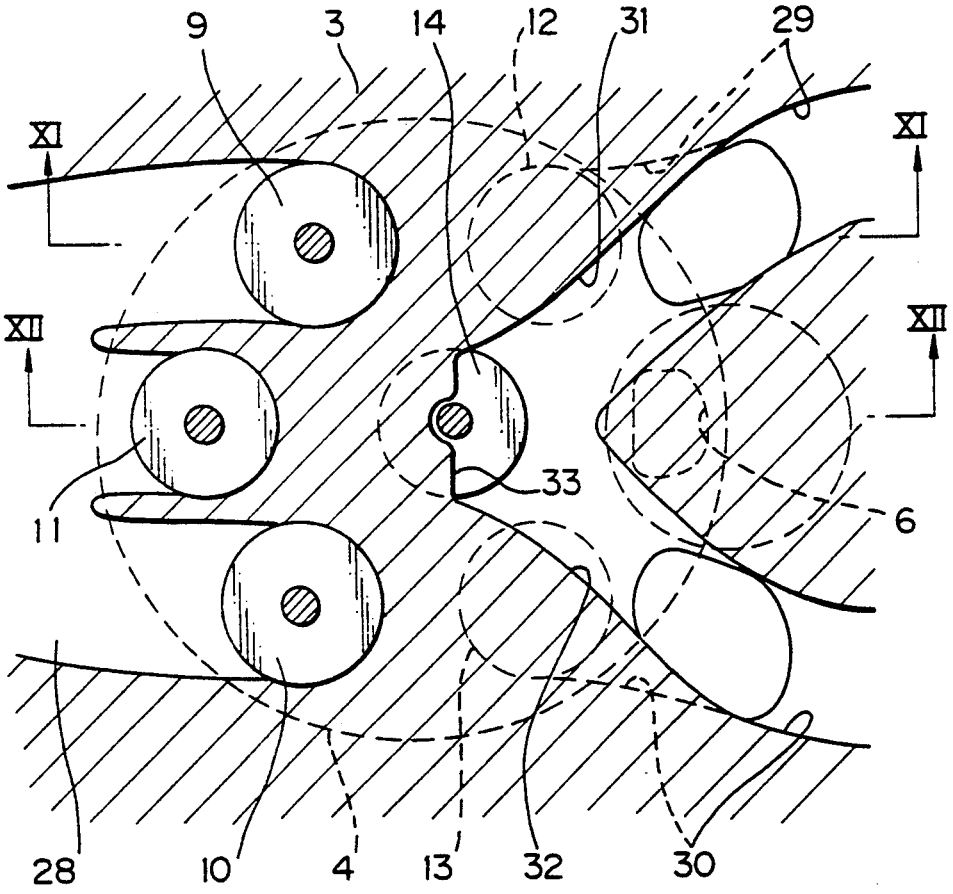
FIG. 10 is a cross-sectional plan view of the cylinder head illustrated in FIG. 9.
Figure 11:
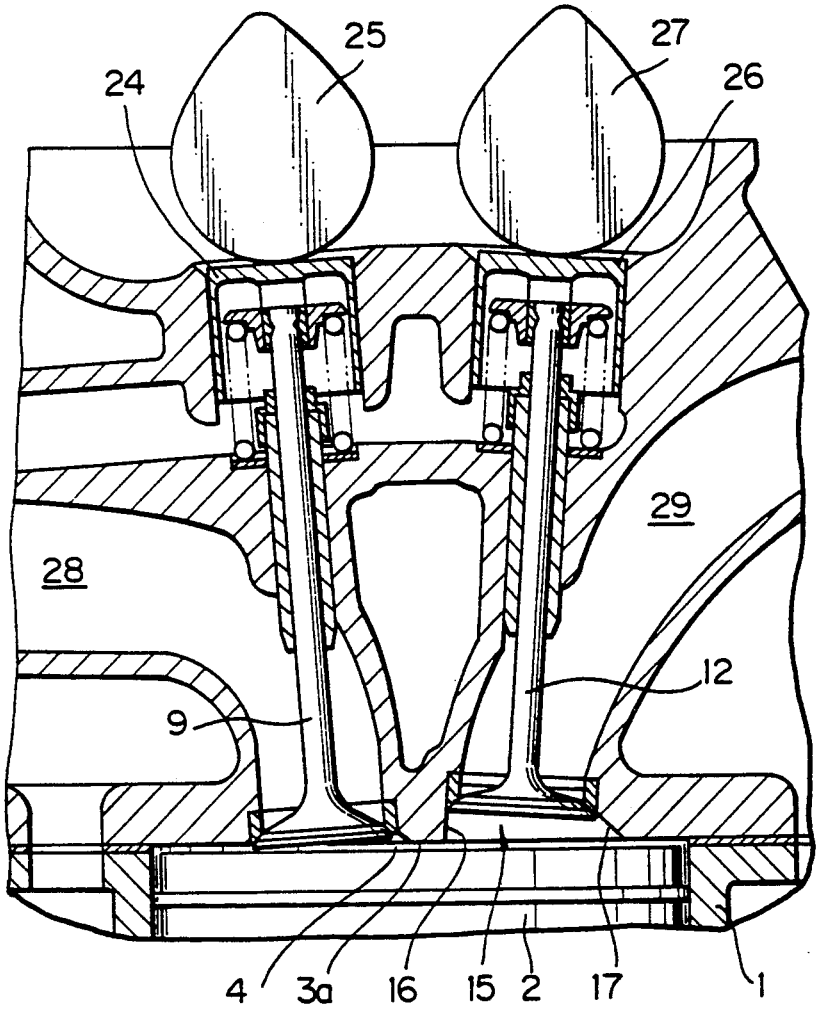
FIG. 11 is a cross-sectional side view of the engine, taken along the line XI—XI in FIG. 10.
Figure 12:
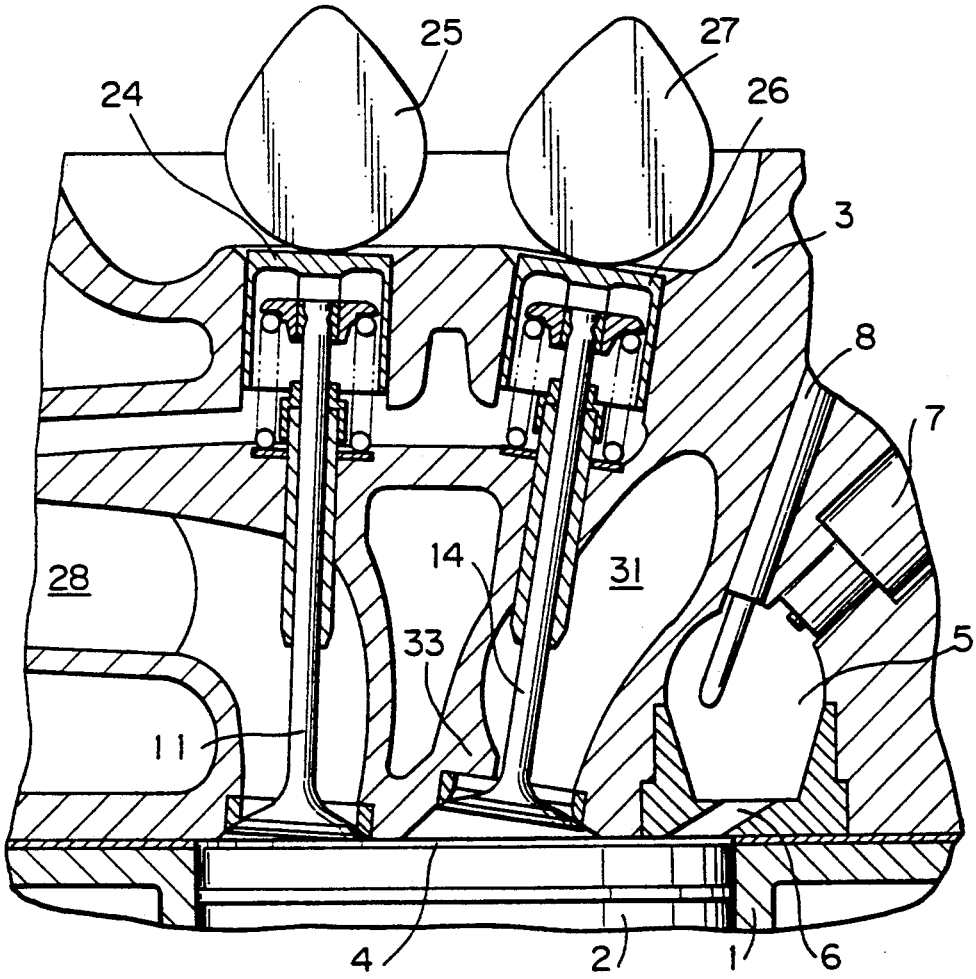
FIG. 12 is a cross-sectional side view of the engine, taken along the line XII—XII in FIG. 10.
Figure 13:
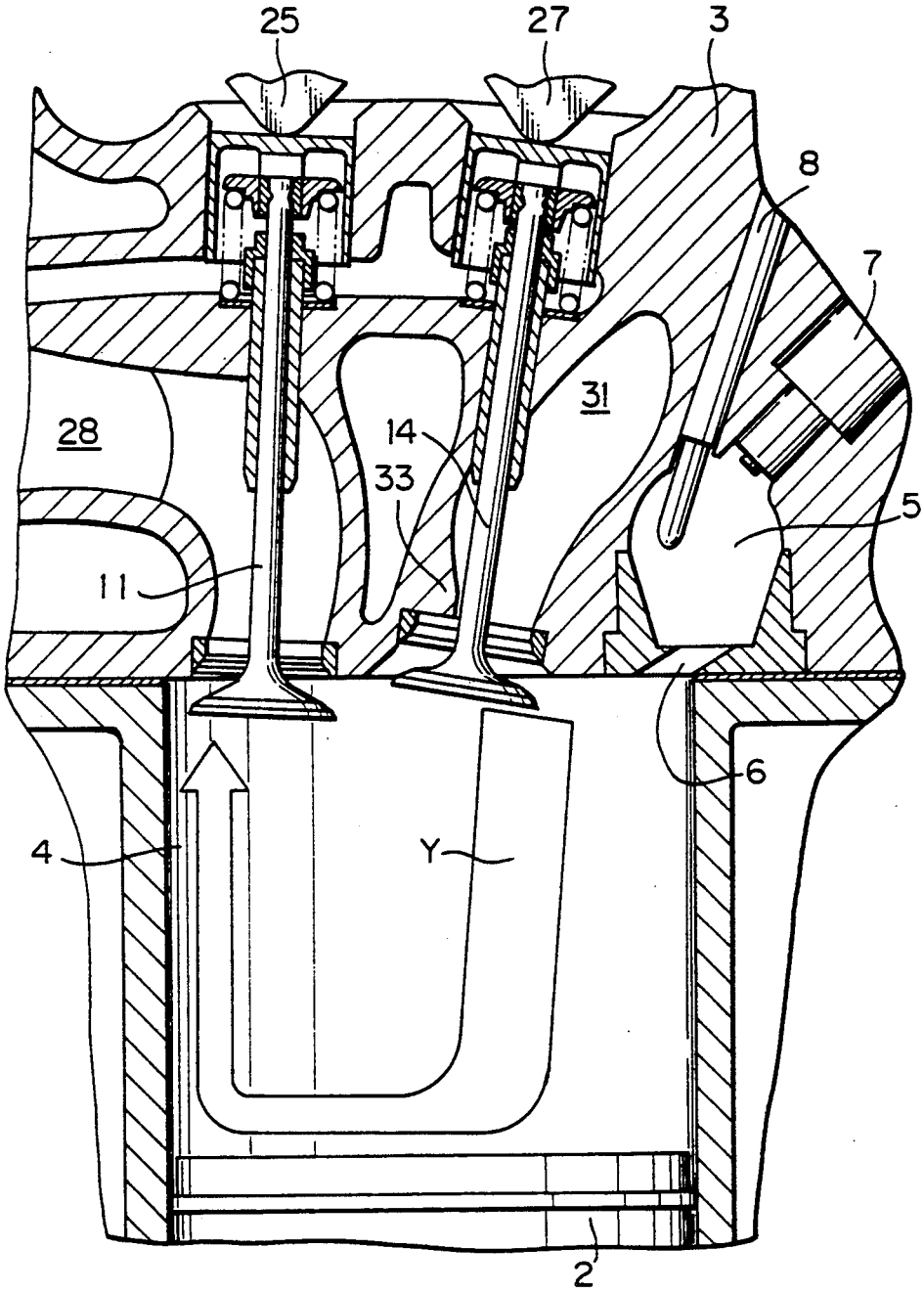
FIG. 13 is a cross-sectional side view of the engine, taken along the same line as in FIG. 12.
Figure 14:
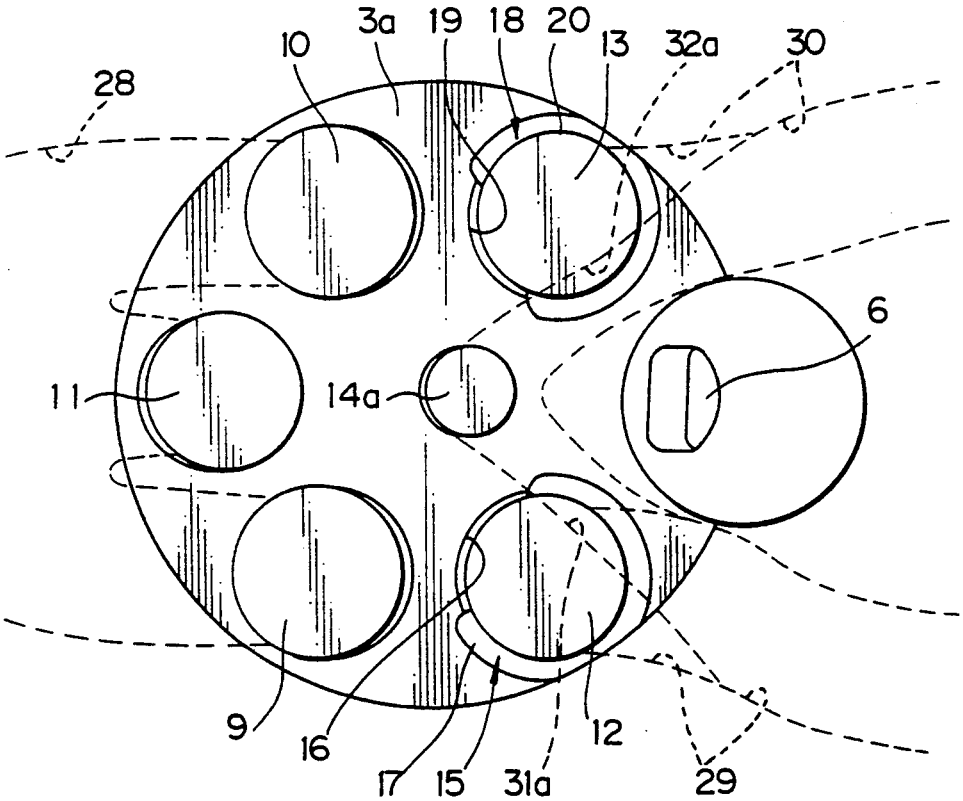
FIG. 14 is a view illustrating the inner wall of the cylinder head of a further embodiment.
Figure 15:
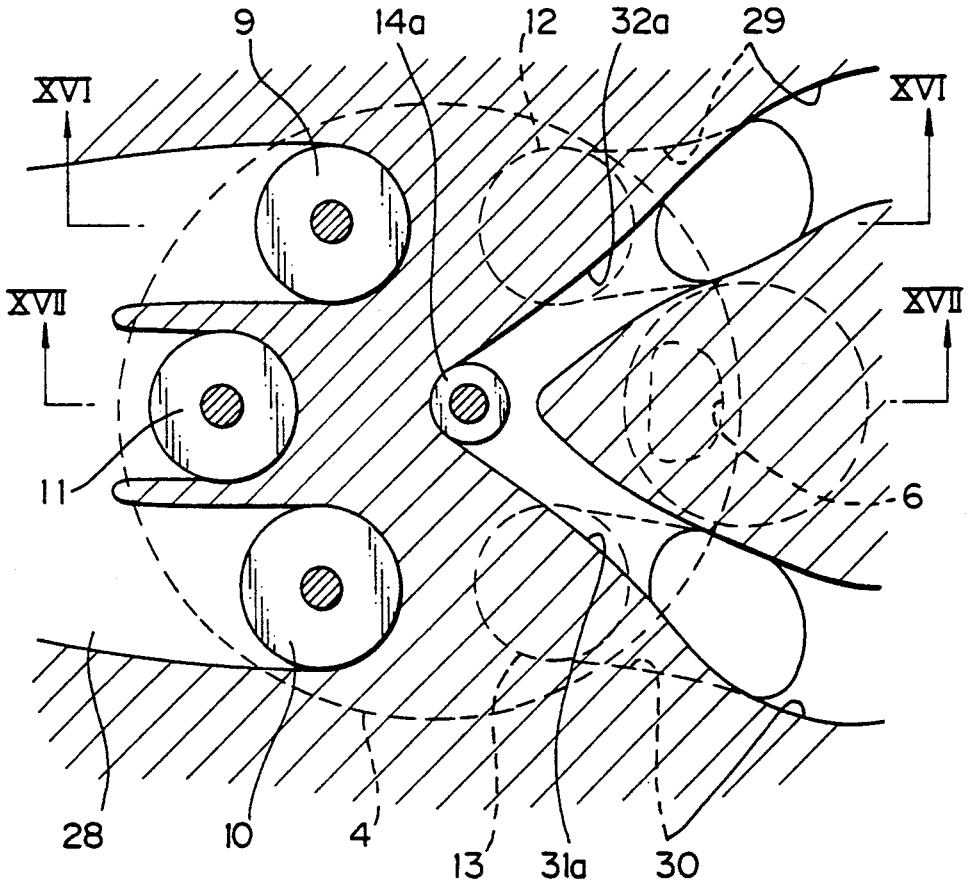
FIG. 15 is a cross-sectional plan view of the cylinder head illustrated in FIG. 14.
Figure 16:
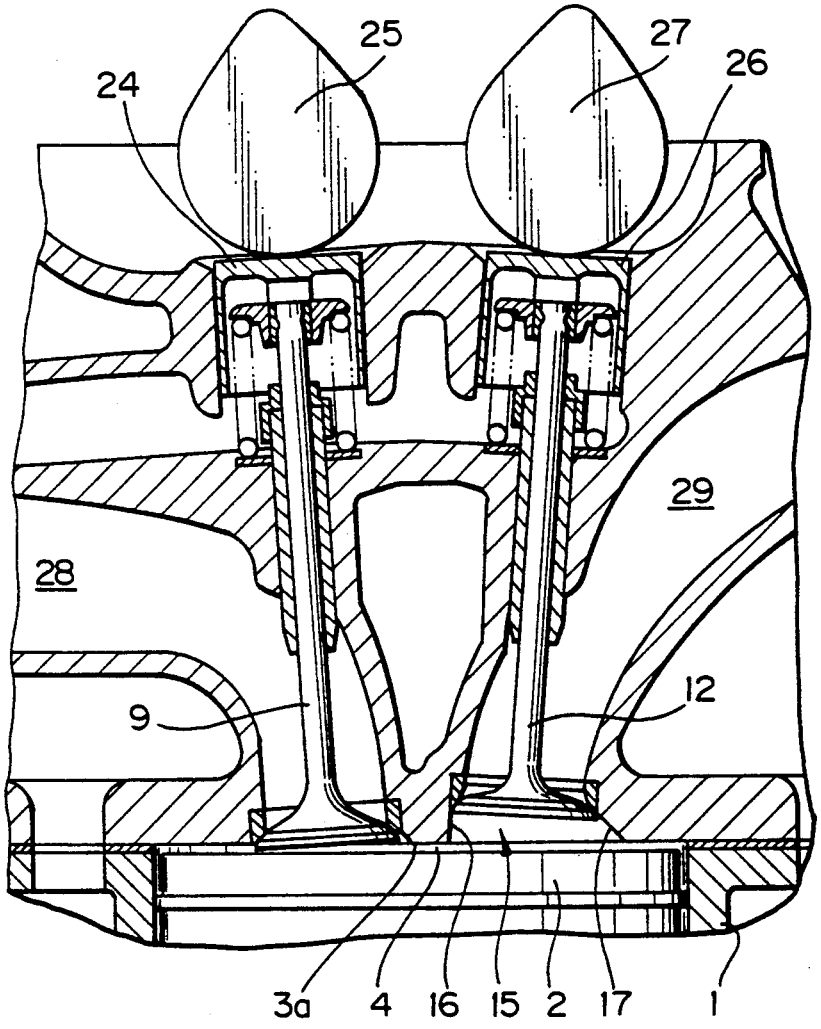
FIG. 16 is a cross-sectional side view of the engine, taken along the line XVI—XVI in FIG. 15.
Figure 17:
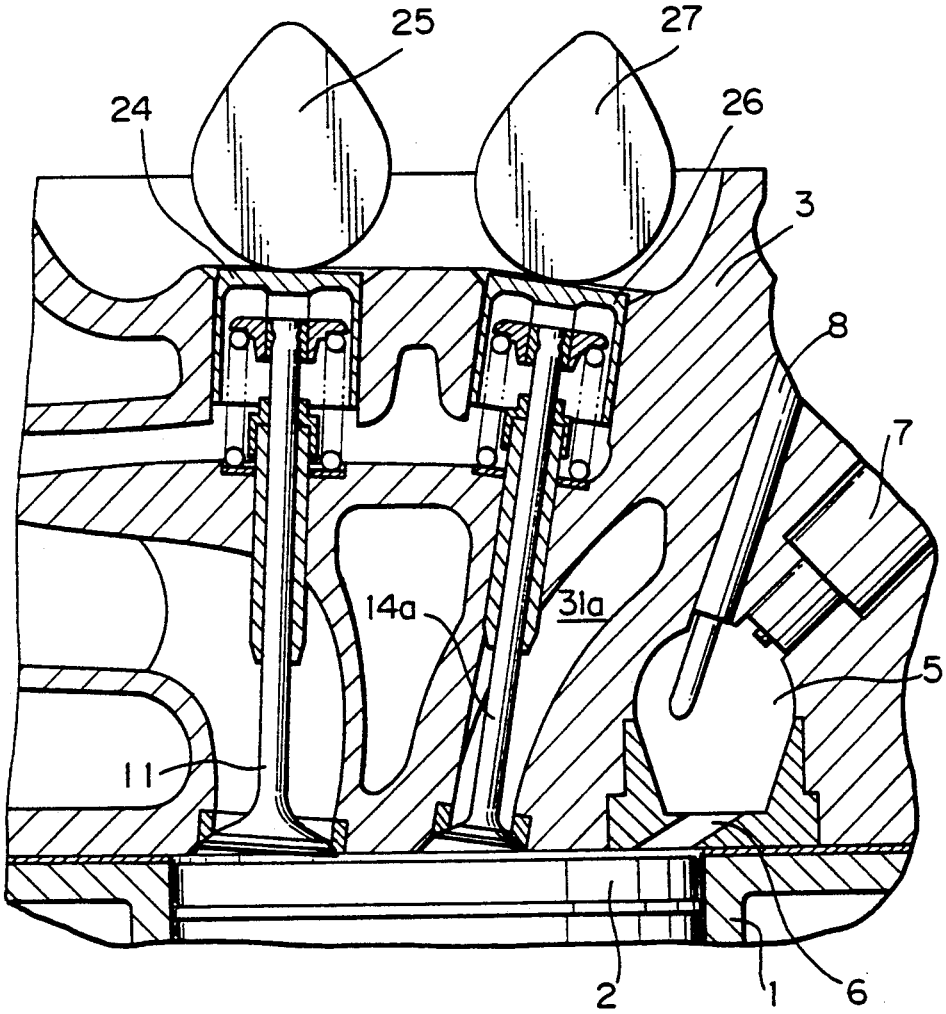
FIG. 17 is a cross-sectional side view of the engine, taken along the line XVII—XVII in FIG. 15.

In this embodiment, however, no masking wall as illustrated in FIG. 4 is provided for the intake valve 14, but a masking wall 33 is formed in the vicinity of the rear face of the valve head of the intake valve 14, as illustrated in FIGS. 10 and 12. This masking wall 33 extends from the inner wall of the merging portion of the branch intake passages 31, 32, which inner wall is located on the exhaust valve 11 side, to a position around the valve stem of the intake valve 14 so that the masking wall 33 covers one half of the rear face of the valve head of the intake valve 14, which half is on the exhaust valve 11 side.

In this embodiment, when the intake valve 14 opens, the fresh air is guided by the masking wall 33 and flows into the main chamber 4 mainly from the valve opening of the intake valve 14, which is located on the opposite side of the exhaust valve 11. Then, the fresh air moves downward toward the top face of the piston 2 in the central portion of the main chamber 4, as illustrated by the arrow Y in FIG. 13. At this time, the fresh air fed from the other intake valves 12, 13 flows along the periphery of the main chamber 4. Accordingly, also in this embodiment, the entire interior of the main chamber 4 is scavenged by the fresh air fed from the intake valves 12, 13, 14.

FIGS. 14 through 18 illustrate a further embodiment. In this embodiment, the exhaust valves 9, 10, 11 and the exhaust port 28 have a construction which is the same as that in the embodiment illustrated in FIGS. 1 through 4, and the intake valves 12, 13, the intake ports 29, 30 and the masking walls 16, 19 have a construction which is the same as that in the embodiment illustrated in FIGS. 1 through 4. In addition, the auxiliary chamber 5 and the opening 6 also have a construction which is the same as that in the embodiment illustrated in FIGS. 1 through 4. Namely, the intake valves 12 and 13 are arranged in the recessed portions 15 and 18 formed on the inner wall 3*a* of the cylinder head 3, respectively, and the valve openings of the intake valves 12, 13, which are located on the exhaust valves side, are masked by the corresponding masking walls 16, 19.

In this embodiment, the valve head of the intake valve 14*a* has a diameter which is considerably smaller than the intake valve 14 used in the embodiment illustrated in FIGS. 1 through 4, and the branch intake passages 31*a*, 32*a* have a cross-sectional area which is considerably smaller than that of the branch intake passages 31, 32 used in the embodiment illustrated in FIGS. 1 through 4. In addition, in this embodiment, no masking wall is provided for the intake valve 14*a*.

Figure 18:
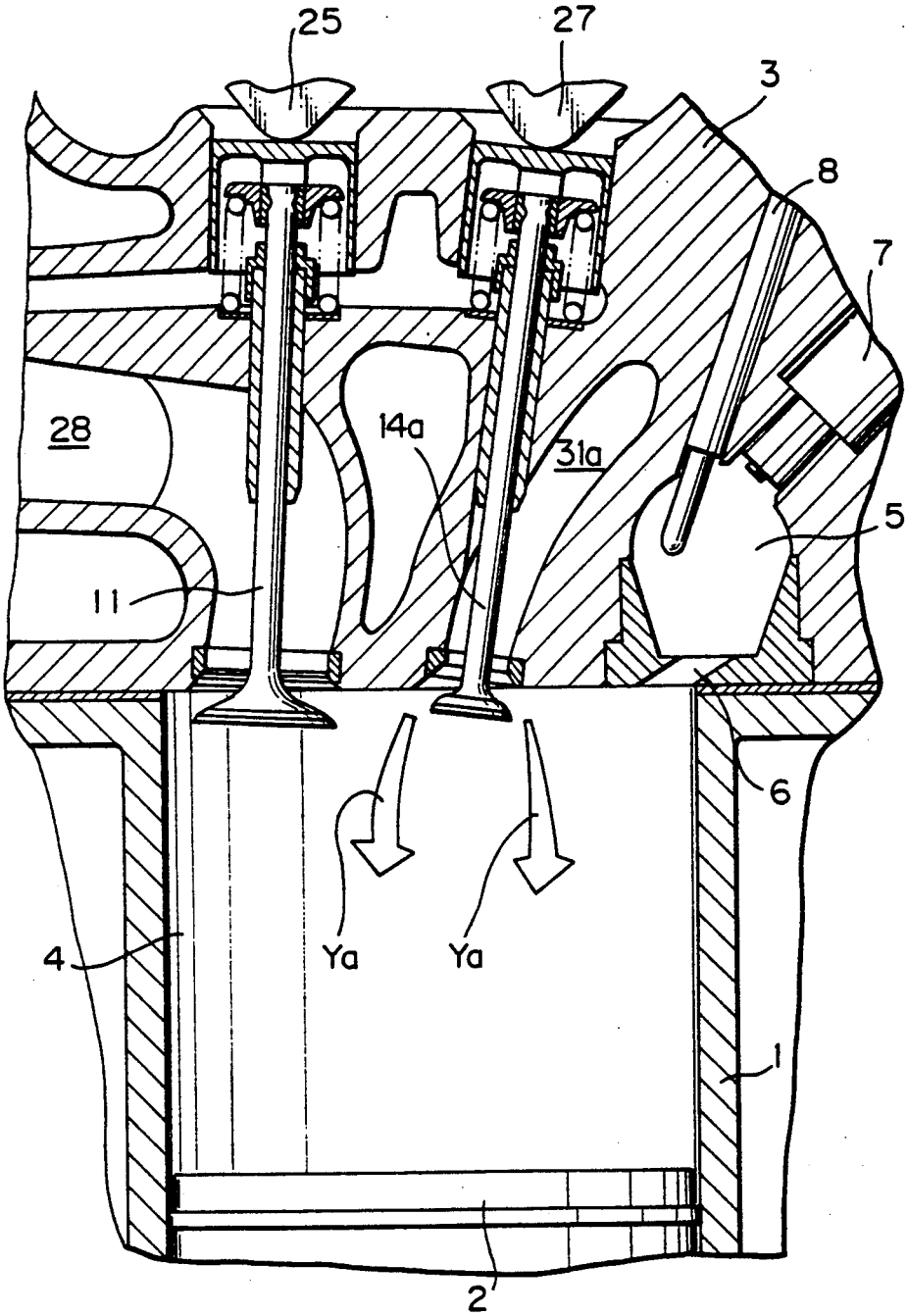
FIG. 18 is a cross-sectional side view of the engine, taken along the same line as in FIG. 17.

In this embodiment, a smaller amount of the fresh air is fed into the main chamber 4 via the intake valve 14*a*, as compared with the embodiment illustrated in FIGS. 1 through 4, and then the fresh air flows toward the central portion of the main chamber 4 as illustrated by the arrows Ya in FIG. 18. Accordingly, in this embodiment, since the central portion of the main chamber 4 is scavenged by the fresh air fed from the intake valve 14*a*, and the peripheral portion of the main chamber 4 is scavenged by the fresh air fed from the other intake valves 12, 13, the entire interior of the main chamber 4 is scavenged.

In this embodiment, since no masking wall is provided for the intake valve 14*a*, a part of the fresh air fed from the intake valve 14*a* escapes to the exhaust port 28. This escaping air does not contribute to the scavenging operation of the unburned gas, and thus this escaping air is useless. However, since the amount of air fed from the intake valve 14*a* is small, the amount of this useless air is also small.

According to the present invention, it is possible to sufficiently scavenge the entire interior of the combustion chamber.

While the invention has been described by reference to specific embodiments chosen for purposes of illustration, it should be apparent that numerous modifications could be made thereto by those skilled in the art without departing from the basic concept and scope of the invention.

We claim:

1. A two-stroke engine having a piston, a cylinder head and a combustion chamber formed between the piston and the cylinder head, said engine comprising:

at least one exhaust valve arranged on a peripheral portion of an inner wall of the cylinder head;

at least one intake valve arranged on a peripheral portion of the inner wall of the cylinder head at a position opposite to said exhaust valve;

preventing means for preventing an inflow of fresh air into the combustion chamber from a valve opening of said intake valve, which is located on the exhaust valve side, and causing the fresh air to flow into the combustion chamber from a valve opening of said intake valve, which is located at a position opposite to said exhaust valve, to cause the fresh air to flow along a periphery of the combustion chamber; and an additional valve arranged at a central portion of the inner wall of the cylinder head to feed fresh air toward a central portion of the combustion chamber.

2. A two-stroke engine according to claim 1, wherein said preventing means comprises a masking wall which masks the valve opening of said intake valve, which is located on the exhaust valve side.

3. A two-stroke engine according to claim 2, wherein said masking wall is formed by a cylindrical inner circumferential wall of a recessed portion which is formed on the inner wall of the cylinder head for receiving said intake valve therein.

4. A two-stroke engine according to claim 2, wherein said masking wall masks the valve opening of said intake valve for the entire time for which said intake valve is open.

5. A two-stroke engine according to claim 2, wherein said masking wall masks the valve opening of said intake valve only when an amount of valve lift of said intake valve is small.

6. A two-stroke engine according to claim 1, further comprising another preventing means for preventing an inflow of fresh air into the combustion chamber from a valve opening of said additional valve, which is located on the exhaust valve side, to cause the fresh air to flow toward the central portion of the combustion chamber.

7. A two-stroke engine according to claim 6, wherein said other preventing means comprises a masking wall which masks the valve opening of said additional valve, which is located on the exhaust valve side.

8. A two-stroke engine according to claim 7, wherein said masking wall is formed by a cylindrical inner circumferential wall of a recessed portion which is formed on the inner wall of the cylinder head for receiving said additional valve therein.

9. A two-stroke engine according to claim 7, wherein said masking wall masks the valve opening of said additional valve for the entire time for which said additional valve is open.

10. A two-stroke engine according to claim 7, wherein said masking wall masks the valve opening of said additional valve only when an amount of valve lift of said additional valve is small.

11. A two-stroke engine according to claim 6, wherein said other preventing means comprises a masking wall arranged in an intake passage for said additional valve to partially cover a rear face of a valve head of said additional valve.

12. A two-stroke engine according to claim 11, wherein said masking wall covers one half of the rear face of said additional valve, which half is on the exhaust valve side.

13. A two-stroke engine according to claim 1, wherein said additional valve has a valve head having a diameter which is smaller than that of a valve head of said intake valve.

14. A two-stroke engine according to claim 1, wherein three exhaust valves are arranged on the peripheral portion of the inner wall of the cylinder head, and two intake valves are arranged on the peripheral portion of the inner wall of the cylinder head at a position opposite to said exhaust valves, said preventing means preventing the inflow of the fresh air into the combustion chamber from valve openings of said intake valves, which are located on the exhaust valves side, and causing the fresh air to flow into the combustion chamber from valve openings of said intake valves, which are located on the opposite of said exhaust valves side, to cause the fresh air to flow along the periphery of the combustion chamber.

15. A two-stroke engine according to claim 14, further comprising an auxiliary chamber having a fuel injector therein, wherein said auxiliary chamber has an opening which is open to the combustion chamber.

16. A two-stroke engine according to claim 15, wherein said opening of said auxiliary chamber is open to the combustion chamber at the peripheral portion of the inner wall of the cylinder head, which portion is located between said intake valves, and said opening of said auxiliary chamber is surrounded by said intake valves and said additional valve.

17. A two-stroke engine according to claim 16, wherein said three exhaust valves, said two intake valves and said opening of said auxiliary chamber are approximately equiangularly arranged on the peripheral portion of the inner wall of the cylinder head about said additional valve.

18. A two-stroke engine according to claim 15, further comprising: a pair of intake ports extending to said corresponding intake valves on each side of said auxiliary chamber; and a pair of branch intake passages branched off from said corresponding intake ports and extending to said additional valve.

19. A two-stroke engine according to claim 18, wherein said branch intake passages extend on each side of said auxiliary chamber and are merged with each other in the vicinity of said additional valve.

20. A two-stroke engine according to claim 18, wherein said branch intake passages have a cross-sectional area which is smaller that of said intake ports, and said additional valve has a valve head having a diameter which is smaller than that of said intake valves.

21. A two-stroke engine according to claim 14, wherein said three exhaust valves are driven by a common cam shaft, and said two intake valves and said additional valve are driven by a common cam shaft.

22. A two-stroke engine according to claim 21, wherein said cam shaft for driving said three exhaust valves is arranged on axes of said three exhaust valves, and said cam shaft for driving said two intake valves and said additional valve are arranged on axes of said two intake valves and said additional valve.

* * * * *